US007936317B2

(12) United States Patent
Nakajima et al.

(10) Patent No.: US 7,936,317 B2
(45) Date of Patent: May 3, 2011

(54) TELEVISION RECEIVING APPARATUS

(75) Inventors: Nobuo Nakajima, Tokyo (JP); Koichi Gyoda, Tokyo (JP); Eiji Shibuya, Kobe (JP); Takehiro Onomatsu, Osaka (JP); Hideto Yoshimura, Osaka (JP)

(73) Assignees: Funai Electric Co., Ltd., Daito-shi, Osaka (JP); The University of Electro-Communications, Choufu-shi, Tokyo (JP); DX Antenna Company, Limited, Kobe-shi, Hyogo-ken (JP)

( * ) Notice: Subject to any disclaimer, the term of this patent is extended or adjusted under 35 U.S.C. 154(b) by 350 days.

(21) Appl. No.: 12/228,788

(22) Filed: Aug. 15, 2008

(65) Prior Publication Data

US 2009/0051605 A1 Feb. 26, 2009

(30) Foreign Application Priority Data

Aug. 22, 2007 (JP) ..... 2007-216292

(51) Int. Cl.
*H01Q 1/24* (2006.01)
*H01Q 1/12* (2006.01)

(52) U.S. Cl. ..... 343/878; 343/702; 343/872; 343/883

(58) Field of Classification Search ..... None
See application file for complete search history.

(56) References Cited

U.S. PATENT DOCUMENTS

| | | | | |
|---|---|---|---|---|
| 6,175,339 | B1 * | 1/2001 | Macon | 343/892 |
| 6,897,816 | B2 * | 5/2005 | Wang | 343/702 |
| 7,113,134 | B1 * | 9/2006 | Berkman | 343/702 |
| 7,142,162 | B2 * | 11/2006 | Taromaru et al. | 343/702 |
| 7,750,867 | B2 * | 7/2010 | Nakajima et al. | 343/872 |
| 2007/0024507 | A1 * | 2/2007 | Kasamatsu et al. | 343/702 |
| 2008/0309826 | A1 * | 12/2008 | Nakajima et al. | 348/725 |

FOREIGN PATENT DOCUMENTS

| | | | |
|---|---|---|---|
| JP | 2005-244885 | A | 9/2005 |
| JP | 2005-295135 | A | 10/2005 |
| JP | 2005-354631 | A | 12/2005 |

* cited by examiner

*Primary Examiner* — Trinh V Dinh
(74) *Attorney, Agent, or Firm* — Yokoi & Co., U.S.A., Inc.; Toshiyuki Yokoi

(57) ABSTRACT

A television receiving apparatus 100 includes a television receiver 20, and a smart antenna 10 having directivity capable of being electrically changed so as to match radio waves to be received. A handle 50 is provided with a mechanism holding the smart antenna 10 therein, fixed to the television receiver 20 and capable of changing the distance between the smart antenna 10 and the television receiver 20 as an antenna holding box. The antenna having directivity capable of being electrically changed so as to match with radio waves to be received is disposed so that the aesthetic appearance can be improved and the signal receiving sensitivity of the antenna can be enhanced.

5 Claims, 6 Drawing Sheets

TELEVISION RECEIVING APPARATUS

CROSS-REFERENCES TO RELATED APPLICATIONS

The entire disclosure of Japan Patent Application No. 2007-216292, filed Aug. 22, 2007, is expressly incorporated by reference herein.

BACKGROUND OF THE INVENTION

1. Field of the Invention

The present invention relates to a television receiving apparatus capable of receiving broadcast television signals and of reproducing images and associated sounds and, more particularly, to a television receiving apparatus provided with an antenna having changeable directivity.

2. Description of the Related Art

A known television receiving apparatus is provided with an antenna having directivity capable of being electrically changed so as to match with radio waves to be received, namely, an antenna commonly called a "smart antenna". For example, a television receiving apparatus disclosed in JP-A 2005-354631 (hereinafter, referred to as "Patent document 1") is such a television receiving apparatus. According to Patent document 1, a smart antenna includes a leg unit to be stably set on a floor, a post extending vertically upward from the leg unit, an antenna holder held on top of the post, and plural receiving devices, namely, directional antennas, held in the antenna holder. The smart antenna is electrically connected to a television receiver by an antenna cable. The smart antenna is controlled by the television receiver on the basis of a predetermined protocol to change the directivity thereof and such.

In connecting the smart antenna to the television receiver installed in a room, it is desirable to dispose the receiving devices in a substantially horizontal position and to separate the receiving devices by a predetermined distance from the metal components of the television receiver to enhance the respective sensitivities of the receiving devices. That is, the receiving devices are arranged in a horizontal plane to receive horizontally polarized waves whereby to change directivity. Since the smart antenna receives radio waves, the smart antenna needs to be separated from the television receiver as far as possible to reduce the influence of the metallic components.

When the smart antenna is disposed in a manner mentioned above, it is possible that the smart antenna and the antenna cable spoil the aesthetic appearance of the television receiving apparatus.

In a television receiving apparatus disclosed in JP-A 2005-244885 (hereinafter, referred to as "Patent document 2"), an array antenna is placed in a horizontal position on a comb-shaped support member supporting a television receiver thereon so that the appearance of the television receiving apparatus may not be spoiled.

In a television receiving apparatus disclosed in JP-A 2005-295135 (hereinafter, referred to "Patent document 3"), an element forming an antenna pattern is incorporated into one of the internal devices, such as a display panel, a chassis and a bezel, of a television receiver, and external devices, such as a carrying handle and a stand, of the television receiver.

Although the aesthetic appearance is not spoiled by incorporating the smart antenna into the television receiver as mentioned in Patent documents 2 or 3, it is difficult to arrange the receiving devices horizontally and to dispose the receiving devices at the predetermined distance from the television receiver and it is possible that the signal sensitivity of the smart antenna is reduced. Thus, the improvement of the aesthetic appearance and the improvement of the signal sensitivity of the smart antenna are contradictory to each other. Nothing about means for making those improvements compatible has been proposed.

BRIEF SUMMARY OF THE INVENTION

The present invention has been made in view of the foregoing problems and it is therefore an object of the present invention to provide a television receiving apparatus provided with an antenna having radio wave receiving directivity capable of being electrically changed and of being disposed so as to improve the appearance and to improve signal receiving sensitivity.

The present invention provides a television receiving apparatus including: a television receiver; an antenna having directivity capable of being electrically changed so as to match with signals to be received; and an antenna holding box holding the antenna therein, fixed to the television receiver, and provided with a distance changing mechanism capable of changing distance between the antenna and the television receiver, wherein the antenna comprises a receiving device which can receives broadcast television signals and is capable of changing directivity of receiving the broadcast television signals, the antenna holding box holds the receiving device horizontally therein, and the distance changing mechanism changes the distance while keeping the receiving device in the antenna holding box in a horizontal position.

In the television receiving apparatus according to the present invention, the antenna holding box holding the antenna therein and fixed to the television receiver is provided with the distance changing mechanism capable of changing the distance between the antenna and the television receiver. Therefore, the antenna disposed near the television receiver is concealed from view, and the antenna can be disposed at a predetermined distance from the television receiver.

Thus, according to the present invention, the antenna disposed near the television receiver is invisible, and the antenna can be disposed at the predetermined distance from the television receiver. Therefore, in disposing the antenna having directivity capable of being electrically changed so as to match with radio waves to be received, the aesthetic appearance can be improved and the signal receiving sensitivity of the antenna can be improved.

In the television receiving apparatus according to the present invention, the antenna holding box may include an antenna holding part holding the antenna with the receiving device therein while keeping the receiving device can receives the broadcast television signals which are horizontally polarized waves and come from horizontal directions, shafts each having a first end connected to the antenna holding part and a second end mounted on the television receiver so as to be slidable to change the distance between the antenna holding part and the television receiver, and a fixing mechanism for fixing the shaft to the television receiver such that the antenna holding part is at the predetermined distance from the television receiver. The antenna can be held easily in the antenna holding box and can be disposed at the predetermined distance from the television receiver.

In the television receiving apparatus according to the present invention, the antenna can be easily held in the antenna holding box and can be disposed at the predetermined distance from the television receiver. Therefore, the aesthetic appearance can be properly improved and the signal receiving sensitivity of the antenna can be properly improved.

The antenna holding box may be a handle attached to an upper part of the television receiver. The antenna can be held in the handle at the predetermined distance from the television receiver.

Since the antenna can be held in the handle at the predetermined distance from the television receiver, the handle can function as an antenna; that is, the antenna can be used as a handle.

The antenna holding box may be a pedestal for supporting the television receiver. The antenna can be held in the pedestal at the predetermined distance from the television receiver.

Since the antenna can be held in the pedestal at the predetermined distance from the television receiver, the pedestal can function as an antenna; that is, the antenna can be used as a stand.

In the television receiving apparatus according to the present invention, the antenna holding box includes an antenna holding part holding a broadcast digital signal receiving device that makes the antenna has a plurality of signal receiving directions in a horizontal plane, two shafts each having a first end connected to the antenna holding part and a second end mounted on the television receiver so as to be slidable to change the distance between the antenna holding part and the television receiver, and a fixing mechanism for fixing the shafts to the television receiver such that the antenna holding part is at the predetermined distance from the television receiver, wherein a section in a horizontal plane of the antenna holding part is substantially elliptic, the respective first ends of the two shafts are connected to opposite ends apart separated from each other of the antenna holding part, the respective second ends of the shafts can be partly or entirely received in the television receiver, and the antenna holding box may by a handle attached to an upper part of the television receiver provided with a 15 to 23 in. display screen. Thus, the antenna can be held in the handle and can be easily separated from the television receiver by the predetermined distance.

According to the present invention, the antenna can be easily held in the handle and can be easily separated from the television receiver by the predetermined distance. Therefore, the handle can function as the antenna (or the antenna can be used as the handle), the aesthetic appearance can be properly improved and the signal receiving sensitivity of the antenna can be properly improved. The television receiver provided with a 15 to 23 in. display screen can be easily carried by hand.

DETAILED DESCRIPTION OF THE INVENTION

A preferred embodiment of the present invention will be described with reference to the accompanying drawings.

Figure 1:
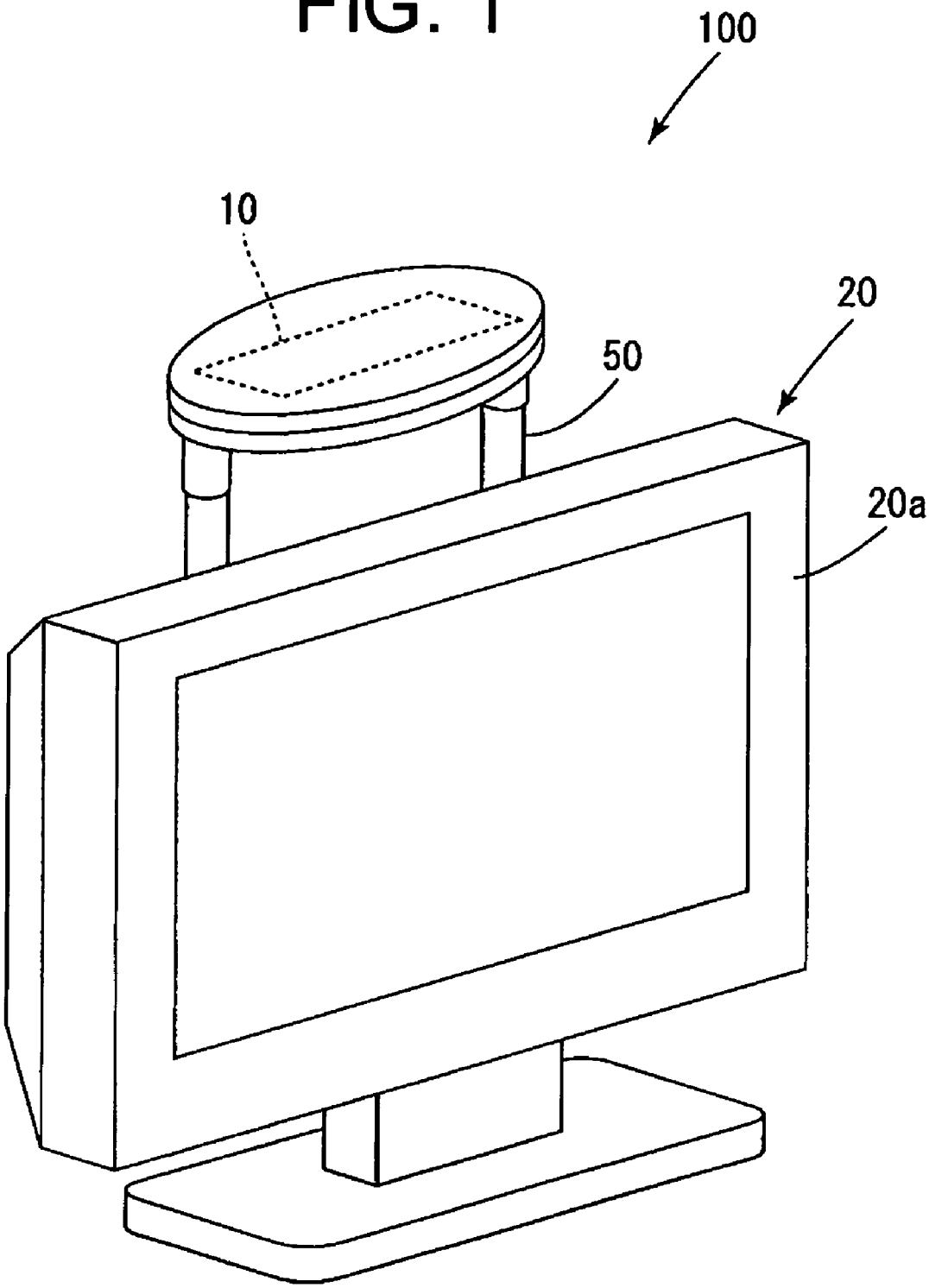
FIG. 1 is a perspective view of an example of a television receiving apparatus.
Figure 2:
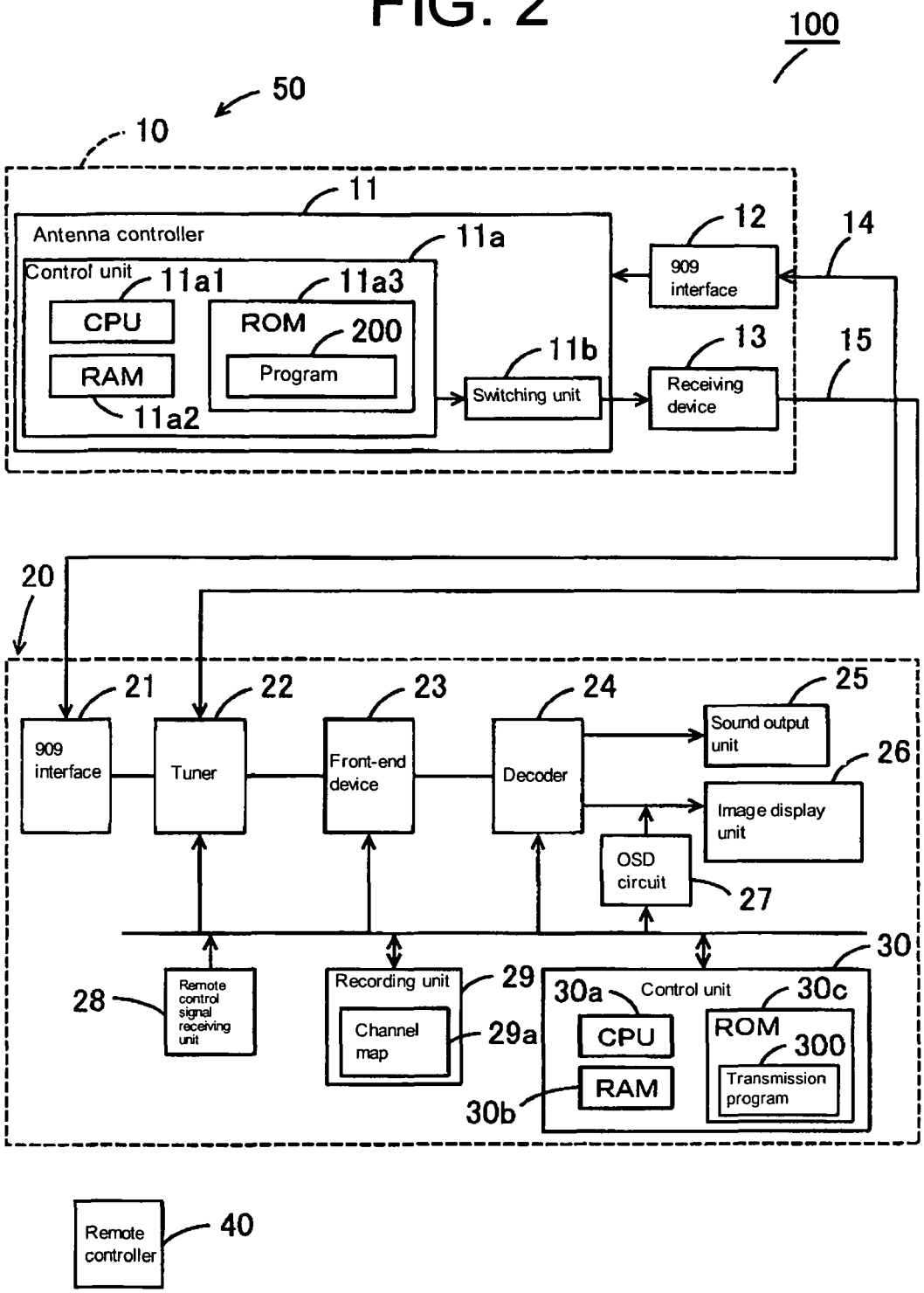
FIG. 2 is a block diagram of an example of a television receiving apparatus.

(1) General Construction of Television receiving apparatus
(2) Construction of Antenna holding box
(3) Modifications
(4) Summary (1) General Construction of Television Receiving Apparatus The general construction of a television receiving apparatus 100 in a preferred embodiment according to the present invention will be described with reference to FIGS. 1 and 2. FIG. 1 is a perspective view of the television receiving apparatus 100 and FIG. 2 is a block diagram of the television receiving apparatus 100. Referring to FIGS. 1 and 2, the television receiving apparatus 100 includes a handle 50 serving also as an antenna holding box holding a smart antenna 10, and a television receiver 20. The smart antenna 10 is connected to the television receiver 20 through an interface (hereinafter, referred to as "909 interface") for communication on the basis of, for example, a predetermined communication protocol, such as EIA/CEA-909. The smart antenna 10 is an antenna for receiving broadcast television signals by electrically changing directivity so as to concentrate its response in a direction from which radio waves, such as horizontally polarized waves for digital terrestrial television broadcasting, are received. The television receiver 20 provides sounds and images based on broadcast television signals received, for example, by the smart antenna 10. Desirably, the television receiver 20 is a flat television receiver, such as a liquid crystal television receiver, a plasma television receiver, a rear projection television receiver or an organic EL television receiver, having a screen size in the range of 15 to 23 in. and capable of being easily carried by holding the handle 50 by hand. Various modifications of the television receiver 20 may be made without departing from the scope of the present invention.

More concretely, the smart antenna 10 includes, for example, an antenna controller 11, a 909 interface 12, and a receiving device 13 having directivity capable of being changed so as to concentrate its response in a direction from which broadcast digital television signals are received. To receive broadcast television signals, the directivity of the receiving device 13 can be electrically changed so as to match with the broadcast television signals.

The 909 interface 12 is connected electrically to a 909 interface 21, which will be described later, included in the television receiver 20 by a 909 cable 14. The 909 interface 12 communicates with the 909 interface 21 of the television receiver 20 on the basis of a predetermined communication protocol, such as EIA/CEA-909, to receive channel information for controlling the receiving device 13 and such and gives the channel information to the to the antenna controller 11.

The antenna controller 11 has a control unit 11*a*. The control unit 11*a* includes, for example, a CPU 11*a*1, a RAM 11*a*2 and a ROM 11*a*3. The CPU 11*a*1 executes control operations according to processing programs stored in the ROM 11*a*3 for the antenna controller 11. The RAM 11*a*2 has a program storage area into which various processing programs to be executed by the CPU 11*a*1 are loaded, a data storage area for storing input data and data obtained by executing the processing program. The ROM 11*a*3 stores system programs executable by the antenna controller 11, processing programs executable according to the system programs, data needed for executing those processing programs, and data obtained through the operations of the CPU 11*a*1. A program 200 is stored in the ROM 11*a*3 in computer-readable programming codes.

The program 200 changes the directivity of the receiving device 13 electrically on the basis of broadcast television signals corresponding to a physical channel number included in channel information obtained by, for example, the CPU 11*a*1. More concretely, the directivity of the receiving device 13, namely, a receiving antenna, is changed on the basis of broadcast television signals identified by a physical channel number included in channel information obtained by the CPU 11*a*1 executed the program 200.

When the CPU 11*a*1 executed the program 200 selects the receiving device 13, a switching unit 11*b* changes the directivity of the receiving device 13 on the basis of direction information included in the channel information obtained by the CPU 11*a*1 executed the program 200 according to a control signal given thereto by, for example, the control unit 11*a*.

The receiving device 13 is connected to, for example, a tuner 22 included in the television receiver 20 by an antenna RF cable 15. The receiving device 13 receives broadcast television signals according to an instruction given thereto by the CPU 11*a*1 executed the program 200. More concretely, the receiving device 13 has directivity that can be set selectively in one of plural directions, such as sixteen directions. The switching unit 11*b* switches the receiving device 13 to set its directivity selectively in one of the plural directions. Then, the receiving device 13 has high sensitivity to broadcast television signals from the selected direction higher than those to broadcast television signals from other directions.

The television receiver 20 includes, for example, the 909 interface 21, the tuner 22, a front-end device 23, a decoder 24, an OSD circuit 27, a remote control signal receiving unit 28, a recording unit 29, and a control unit 30. The television receiver 20 receives received broadcast television signals from the smart antenna 10 and generates sounds and images. The television receiver 20 is provided with a sound output unit 25 for generating sounds and an image display unit 26 for displaying images. The sound output unit 25 and the image display unit 26 are connected to the decoder 24. The television receiver 20 is provided with a remote controller 40 capable of communicating with the remote control signal receiving unit 28. The remote controller 40 is used for operating the television receiver 20. Those component units are arranged in a cabinet 20*a* made of a resin. The cabinet 20*a* also holds in its upper part a part of the handle 50.

The 909 interface 21 is connected electrically to, for example, the 909 interface 12 of the smart antenna 10 by the 909 cable 14. For example, the 909 interface 21 communicates with the 909 interface 12 of the smart antenna 10 on the basis of a predetermined communication protocol, such as EIA/CEA-909 according to control signals given thereto by the control unit 30 and sends channel information or the like for controlling the smart antenna 10 to the smart antenna 10.

For example, the tuner 22 is connected electrically to the receiving device 13 of the smart antenna 10 by the antenna RF cable 15. The tuner 22 selects broadcast television signals on a channel selected by the user according to a control signal given thereto by the control unit 30 from among broadcast television signals provided by the receiving device 13 and gives the selected broadcast television signals to the front-end device 23.

The front-end device 23 converts the broadcast television signals received from the tuner 22 into IF signals, for example, according to a control signal given thereto by the control unit 30 and sends the IF signals to the decoder 24.

The decoder 24 processes the broadcast television signals provided by the front-end device 23 in conformity with a predetermined file format, such as MPEG-2 format (Moving picture experts group phase 2 format) according to, for example, control signals received from the control unit 30 to decode the broadcast television signals, and provides sound signals and image signals separately. The sound and the image signals obtained by decoding the broadcast television signals are given respectively to the sound output unit 25 and the image display unit 26.

The sound output unit 25 is, for example, a loudspeaker or the like. The sound output unit 25 generates sounds represented by sound data based on the sound signals provided by the decoder 24.

The image display unit 26 is, for example, a liquid crystal display or the like. The image display unit 26 displays images represented by image data based on the image signals provided by the decoder 24 or images represented by image data based on composite image signals obtained by combining OSD display signals, which will be described later, with image signals provided by the decoder 24 by the OSD circuit 27.

The OSD circuit 27 combines OSD display signals for making the image display unit 26 execute a predetermined OSD display (on-screen display) with the image signals given by the decoder 24 to the image display unit 26 according to, for example, control signals received from the control unit 30.

The remote control signal receiving unit 28 receives signals from, for example, the remote controller 40 and gives data corresponding to the received signals to the control unit 30.

The remote controller 40 is operated by, for example, the user and sends signals corresponding to user's operations to the remote control signal receiving unit 28. More concretely, the remote controller 40 is provided with, for example, channel keys and an up-down key to be operated, for example, to specify a selected channel.

The recording unit 29 includes, for example, a magnetic recording medium, an optical recording medium or a semiconductor memory. More concretely, a channel map 29*a* and such are recorded in the recording unit 29. Recorded in the channel map 29*a* are, for example, channel information and such. More concretely, correspondingly recorded in the channel map 29*a* are, for example, imaginary channel numbers assigned respectively to the channel keys and the up-down key of the remote controller 40, physical channel numbers, direction information about directions related with the directivity of the smart antenna 10, and gain information about the gain of the smart antenna 10. The information recorded in the channel map 29*a* is determined by, for example, a process for initializing the television receiving apparatus 100 and is recorded in the channel map 29*a*.

The control unit 30 is provided with, for example, a CPU 30*a*, a RAM 30*b* and a ROM 30*c*. The CPU 30*a* executes various control operations according to various processing programs stored in the ROM 30*c* for the television receiver 20. The RAM 30*b* has a program storage area into which various processing programs to be executed by the CPU 30*a* are loaded, and a data storage area for storing input data and data obtained by executing the processing programs.

The ROM 30*c* stores system programs executable by the television receiver 20, processing programs executable according to the system programs, data needed for executing those processing programs, and data obtained through the operations of the CPU 30*a*. The programs are stored in the ROM 30*c* in computer-readable programming codes. More concretely, the ROM 30*c* stores, for example, a transmission program 300 and such.

The transmission program 300 is executed by the CPU 30*a* to transmit channel information through, for example, the 909 interface 21 to the smart antenna 10. More concretely, when a desired channel is selected, for example, by the user by operating the channel key or the up-down key of the remote controller 40, the CPU 30*a* retrieves channel information, such as physical channel number, direction information and gain information, corresponding to the channel number (imaginary channel number) of the selected channel from the channel map 29*a* of the recording unit 29, and transmits the channel information through the 909 interface 21 to the antenna controller 11 of the smart antenna 10. Then, the directivity of the smart antenna 10 is changed to receive broadcast television signals on the selected channel.

(2) Construction of Antenna Holding Box

Figure 3:
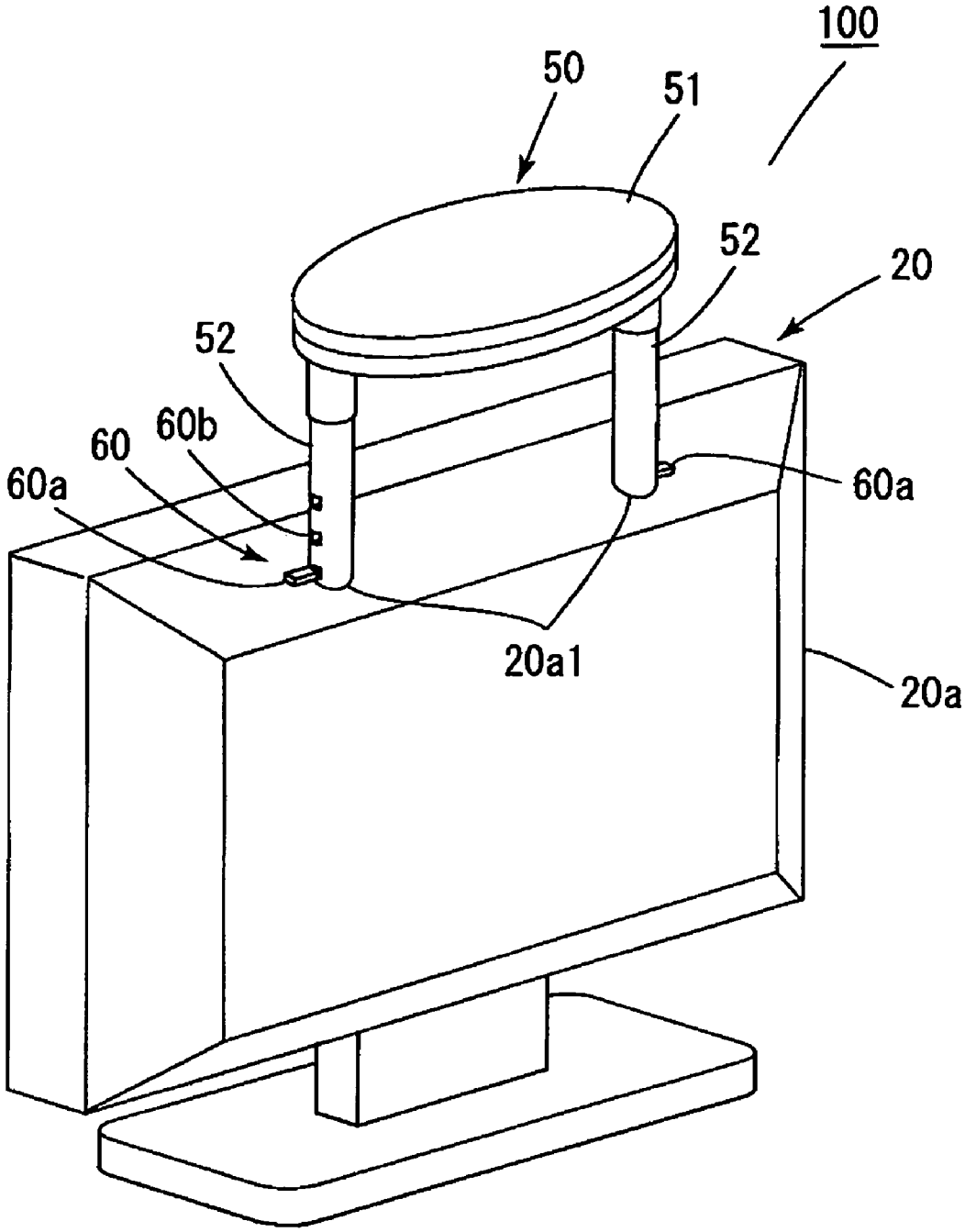
FIG. 3 is a perspective view of a television receiver, and a handle serving as an antenna holding box and attached to an upper part of the television receiver.
Figure 4:
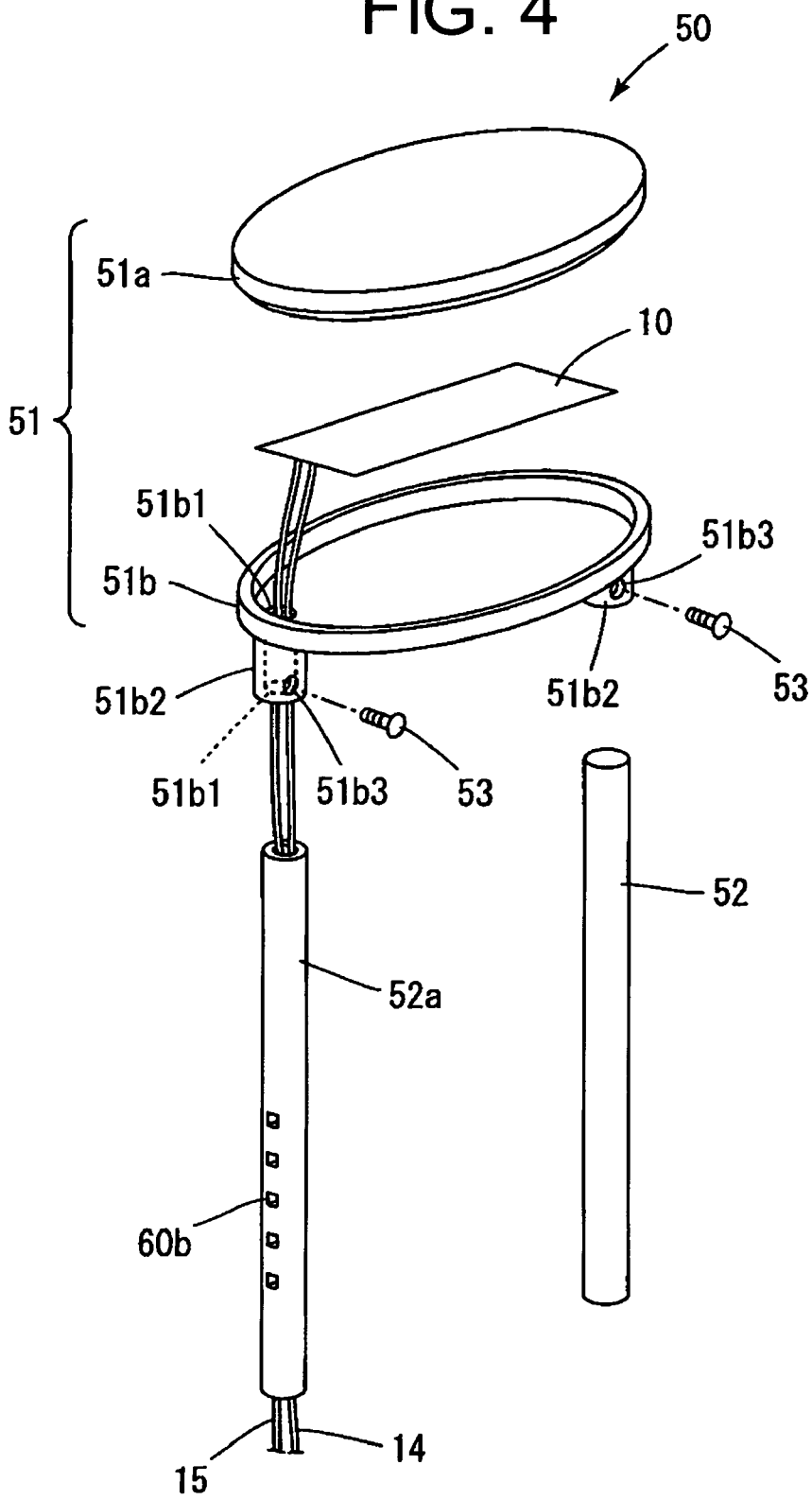
FIG. 4 is a fragmentary, exploded perspective view of the handle.

FIG. 3 is a perspective view showing the handle 50 attached to an upper part of the television receiver 20 by way of example. FIG. 4 is an exploded perspective view showing the construction of the handle 50 by way of example. Referring to FIGS. 3 and 4, the handle 50 has an antenna holding part 51 holding the receiving device 13 forming, for example, the smart antenna 10 such that signal receiving directions from which the receiving device 13 receives signals are horizontal to receive digital, horizontally polarized waves, two shafts 52, namely, a shaft 52 and 52*a*, each having a first end joined to the antenna holding part 51, and a second end connected to the television receiver 20 so as to be slidable relative to the television receiver 20 to adjust the distance between the antenna holding part 51 and the television receiver 20 and fixed to the television receiver 20 by a fixing mechanism 60. Thus the handle 50 holding the smart antenna 10 can be fixed to the television receiver 20 and the distance between the smart antenna 10 and the television receiver 20 can be changed. The handle 50 included in the television receiving apparatus 100 has the antenna holding part 51 and the shafts 52 forming a distance changing mechanism for changing the distance between the smart antenna 10 and the television receiver 20.

The smart antenna 10 has the receiving device 13 having directivity that can be changed to receive horizontally polarized television signals. The antenna holding part 51 holds the smart antenna 10 such that the receiving device 13 can receive signals from horizontal directions. For example, a wiring board provided with the smart antenna 10 is held horizontally in the antenna holding part 51. The antenna holding part 51 has an upper holding member 51*a* capable holding the smart antenna 10 in a horizontal position, and a lower holding member 51*b*. The holding part 51 is formed in a shape having a substantially elliptic horizontal section to facilitate gripping the antenna holding part 51 when the user carries the television receiving apparatus 100 by hand. The antenna holding part 51 is made of, for example, a resin to avoid deteriorating the signal receiving sensitivity of the smart antenna 10.

The upper holding member 51*a* of the antenna holding part 51 is an elliptic member defining a recess capable of holding the smart antenna 10 therein. The lower holding member 51*b* is an elliptic member defining a recess capable of holding the smart antenna 10 therein. Connecting members 51*b*2 project from opposite end parts of the lower wall of the lower holding member 51*b*, respectively. The connecting members 51*b*2 have bores 51*b*1 in which the shafts 52 and 52*a* are fixedly received, respectively. The bore 51*b*1 of the connecting member 51*b*2 extends through the bottom wall of the lower holding member 51*b*. The 909 cable 14 and the antenna RF cable 15 connected to the smart antenna 10 are passed through the bore 51*b*1. The upper holding member 51*a* is fixed to the lower holding member 51*b* so as to cover the lower holding member 51*b* after passing the 909 cable 14 and the antenna RF cable 15 through the bore 51*b*1 to hold the smart antenna 10 in the antenna holding part 51. Thus, the smart antenna 10 is concealed from view and does not spoil the aesthetic appearance.

The shafts 52 and 52*a* holds the antenna holding part 51 and the smart antenna 10 hold in the antenna holding part 51 above the television receiver 20. The 909 cable 14 and the antenna RF cable 15 to be connected to the television receiver 20 are extended through the shaft 52*a* in this embodiment when the smart antenna 10 is fixedly supported on the television receiver 20. Thus the 909 cable 14 and the antenna RF cable 15 are concealed from view and do not spoil the aesthetic appearance. The shaft 52*a* can protect the 909 cable 14 and the antenna RF cable 15 extended therein against breakage.

The shafts 52 and 52*a* have the shape of a circular cylinder having a predetermined length. At least the shaft 52*a* has the shape of a round tube to contain the 909 cable 14 and the antenna RF cable 15. The respective second ends of the shafts 52 and 52*a* are provided with plural axially arranged openings 60*b*. The shafts 52 and 52*a* are made of, for example, a resin or the like to avoid deteriorating the signal receiving sensitivity of the smart antenna 10.

Openings 20*a*1 are formed in the upper wall of the cabinet 20*a* to receive the second ends of the shafts 52 and 52*a*. The upper wall of the cabinet 20*a* is provided with stoppers 60*a* to be fitted in desired ones of the openings 60*b*, respectively, to hold the shafts 52 and 52*a* fixedly at predetermined positions, respectively. The stoppers 60*a* and the openings 60*b* form the fixing mechanism 60.

The respective first ends of two shafts 52 and 52*a* are inserted into the bores 51*b*1 of the connecting members 51*b*2, respectively, so as to be separated from each other and to be fixedly connected to the antenna holding part 51. The 909 cable 14 and the antenna RF cable 15 extended from the smart antenna 10 held in the antenna holding part 51 and passed through the bore 51*b*1 is extended through the cylindrical bore of the shaft 52*a*. The connecting members 51*b*2 are provided with internally threaded holes 51*b*3. Screws 53 are screwed in the internally threaded holes 51*b*3 so as to be pressed against the first ends of the shafts 52 and 52*a* inserted into the connecting members 52 and 52*a* to fix the shafts 52 and 52*a* in place. The second ends of the shafts 52 and 52*a* are inserted in the openings 20*a*1 formed in the upper wall of the cabinet 20*a* so that the second ends are partly or entirely received in the television receiver 20. The shafts 52 and 52*a* are fixed to the cabinet 20*a* by the fixing mechanism 60 to support the antenna holding part 51 at a predetermined distance from the television receiver 20 so that the smart antenna 10 may have a proper signal receiving sensitivity. For example, positions where the shafts 52 and 52*a* are to be fixed, respectively, can be adjusted, viewing the condition of displayed images.

(3) Modifications

Another method of attaching the handle 50 to the television receiver 20 will be described.

Figure 5:
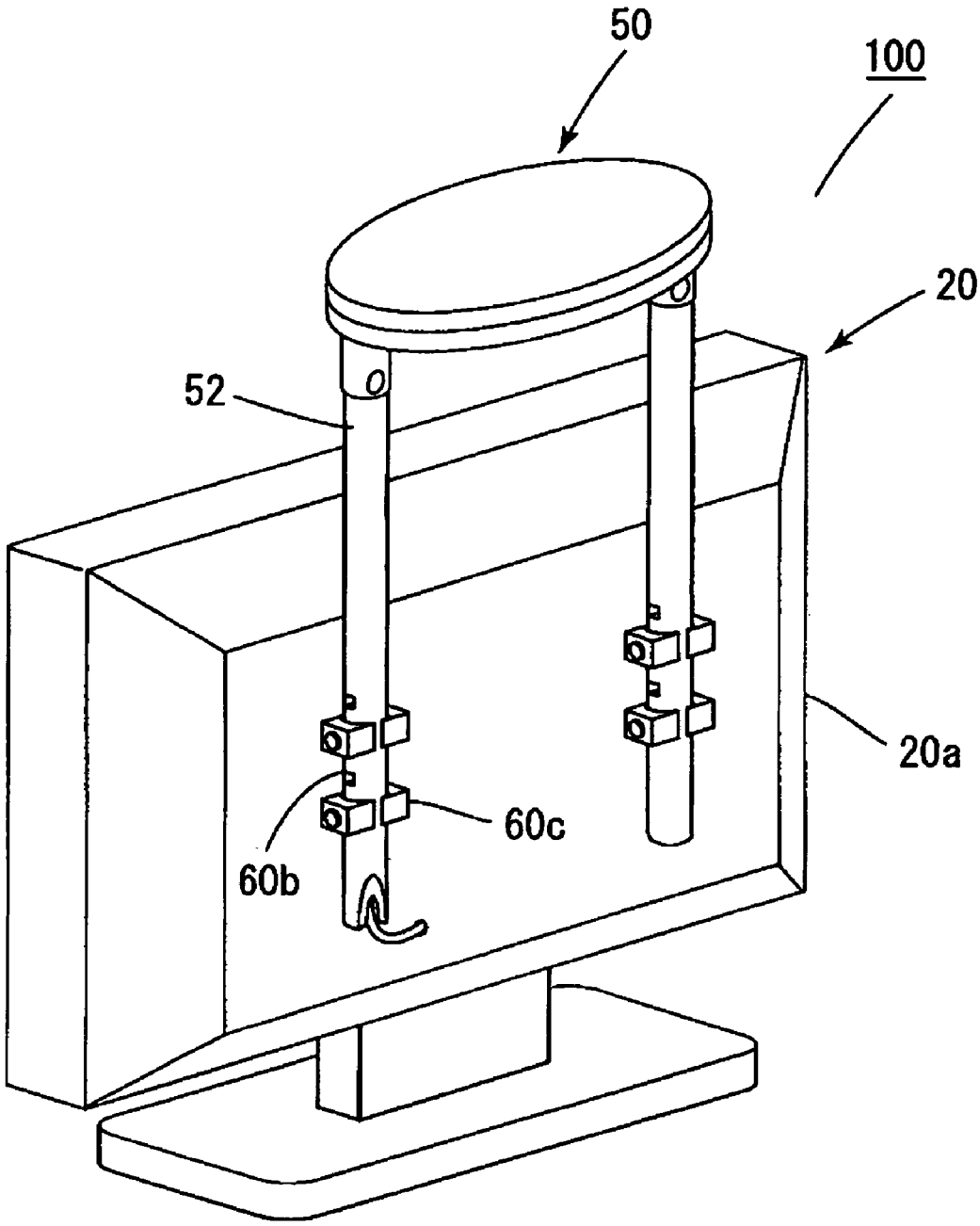
FIG. 5 is a perspective view of a television receiving apparatus including a television receiver and a handle attached to the back wall of the television receiver.

FIG. 5 shows the television receiver 20 and the handle 50 attached to the back surface of the television receiver 20 in a perspective view. Referring to FIG. 5, the two shafts 52 are fixedly held on the cabinet 20*a* by fixing members 60*c* formed on the back wall of the cabinet 20*a* and grooves 60*b* such that the antenna holding part 51 is at a position where the smart antenna 10 has a proper signal receiving sensitivity at a predetermined distance from the television receiver 20. The fixing members 60*c* and the grooves 60*b* form a fixing mechanism 60.

An antenna holding box in a modification will be described.

Figure 6:
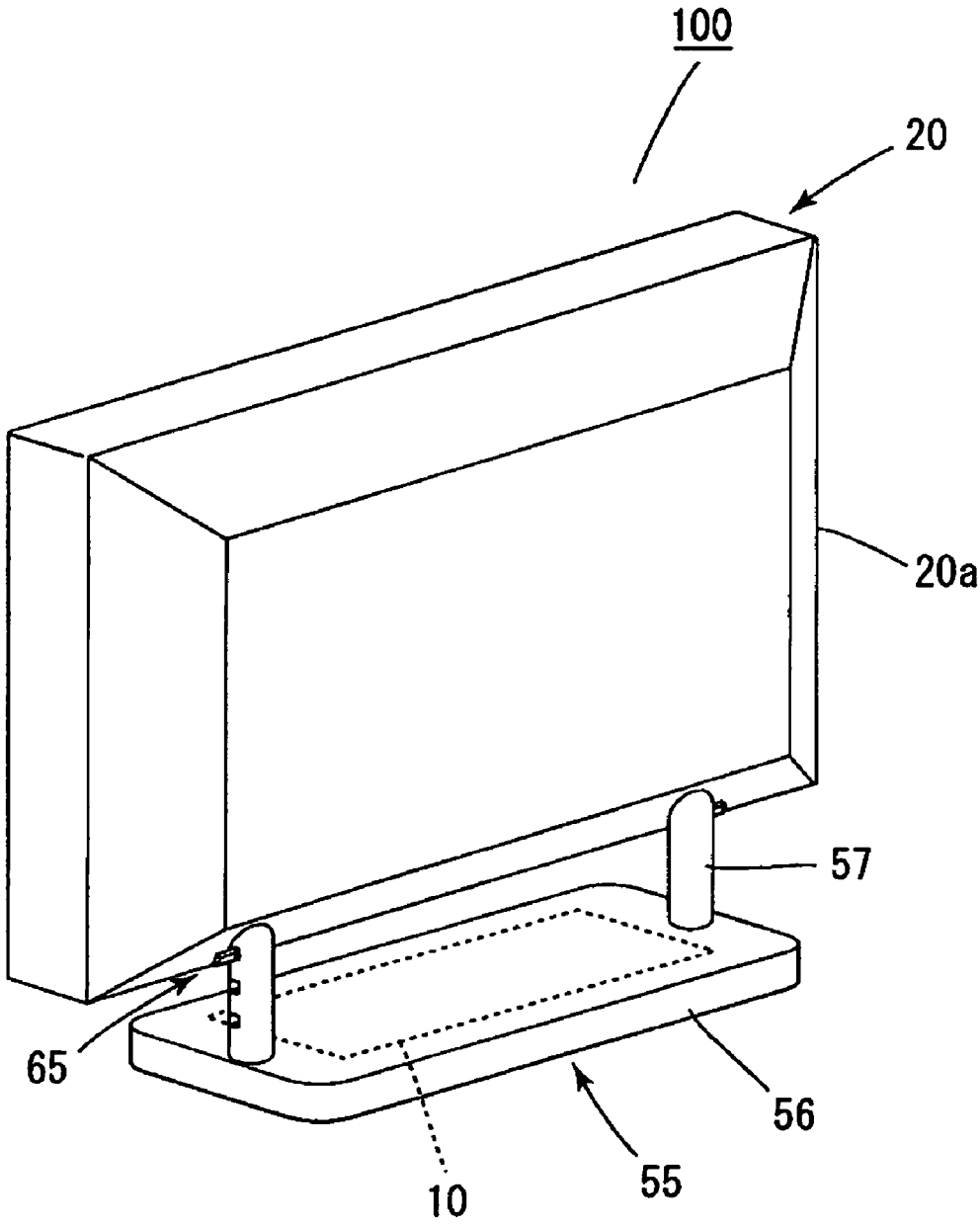
FIG. 6 is a perspective view of a television receiving apparatus including a television receiver, and a stand serving as an antenna holding box.

FIG. 6 shows a pedestal 55 serving as an antenna holding box and attached to a lower part of a television receiver 20 by way of example in a perspective view. Referring to FIG. 6, the pedestal 55 has an antenna holding part 56 holding a smart antenna 10 including a receiving device 13 with the receiving device 13 set such that signal receiving directions from which the receiving device 13 receives signals are horizontal, two shafts 57 each having a first end connected to the antenna holding part 56 and a second end mounted on the television receiver 20 so as to be slidable to change the distance between the antenna holding part 56 and the television receiver 20, and a fixing mechanism 65 for fixing the shafts 57 to the television receiver 20 such that the antenna holding part 56 is at the predetermined distance from the television receiver 20. Thus the pedestal 55 holding the smart antenna 10 therein is fixed to the television receiver 20. The distance between the smart antenna 10 and the television receiver 20 can be changed by lifting up the television receiver 20. The pedestal 55 is similar to the handle 50 in construction and other respects and hence the description thereof will be omitted. A television receiving apparatus 100 including the television receiver 20 is provided with the pedestal 55 including the antenna holding part 56 holding the smart antenna 10, fixedly held on the television receiver 20 so as to be movable to change the distance between the smart antenna 10 and the television receiver 20, and the shafts 57. Desirably, the television receiver 20 is a flat television receiver having a screen size in the range of 15 to 23 in and capable of being easily lifted up by hand. Various modifications of the television receiver 20 may be made without departing from the scope of the present invention.

CONCLUSION

The television receiving apparatus 100 in this embodiment has the handle 50 or the pedestal 55, namely, the antenna holding box holding the smart antenna 10, fixed to the television receiver 20 and capable of being moved to change the distance between the smart antenna 10 and the television receiver 20. The smart antenna 10 concealed from view can be disposed near the television receiver at the predetermined distance from the television receiver 20. Thus, present invention provides the television receiving apparatus 100 provided with the smart antenna 10 having directivity capable of being electrically changed so as to match with radio waves to be received, and capable of being disposed so as to improve the appearance and to enhance the signal receiving sensitivity thereof.

In the television receiving apparatus 100 in this embodiment, the handle 50 (or the pedestal 55) serving as the antenna holding box has the antenna holding part 51 (or the antenna holding part 56) holding the receiving device 13 forming the smart antenna 10 such that signal receiving directions from which the receiving device 13 receives signals are horizontal, the two shafts 52 (or the shafts 57) each having the first end joined to the antenna holding part 51 (or the antenna holding part 56), and the second end connected to the television receiver 20 so as to be slidable relative to the television receiver 20 to adjust the distance between the antenna holding part 51 (or the antenna holding part 56) and the television receiver 20 and fixed to the television receiver 20 by the fixing mechanism 60 (or the fixing mechanism 65). Thus, the smart antenna 10 can be easily held in the antenna holding box and can be easily separated from the television receiver 20 by the predetermined distance, the aesthetic appearance can be properly improved and the signal receiving sensitivity of the smart antenna 10 can be properly improved.

In the television receiving apparatus 100 in this embodiment, the antenna holding box attached to the upper part of the television receiver 20 serves as the handle 50. Therefore, the smart antenna 10 can be held in the antenna holding box at the predetermined distance from the television receiver 20, and the handle 50 can serve as an antenna. From a different point of view, the smart antenna 10 can be used as a handle.

In a modification, the antenna holding box serves as the pedestal 55 for supporting the television receiver 20. Therefore, the smart antenna 10 can be held in the pedestal 55 at the predetermined distance from the television receiver 20, and the pedestal 55 can serve as an antenna. From a different point of view, the smart antenna 10 can be used as a pedestal.

In the television receiving apparatus 100 in this embodiment, a section in a horizontal plane of the antenna holding part 51 is substantially elliptic, the respective first ends of the two shafts 52 are connected to opposite ends apart from each other of the antenna holding part 51, the respective second ends of the shafts 52 can be partly or entirely received in the television receiver 20, and the handle 50 is attached to the upper part of the television receiver 20 provided with a 15 to 23 in. display screen. Thus, the smart antenna 10 can be easily held in the handle 50 and can be easily separated from the television receiver 20 by the predetermined distance. Thus, the handle 50 can be used as an antenna or the smart antenna 10 can be used as a handle, the aesthetic appearance can be properly improved and the signal receiving sensitivity of the smart antenna 10 can be properly enhanced. The television receiving apparatus 100 provided with the 15 to 23 in. display screen can be easily carried by hand.

Although the preferred embodiment of the present invention has been described, the present invention can be embodied by other embodiments.

Although the handle 50 of the foregoing embodiment, for example, is provided with the two shafts 52, and the pedestal 55 of the foregoing modification, for example, is provided with the two shafts 57, each of the handle 50 and the pedestal 55 may be provided with a single shaft.

Although the handle 50 of the foregoing embodiment and the pedestal 55 of the foregoing modification are fixed to the television receivers 20 by the fixing mechanisms 60 and 65, respectively, such that the distance between the antenna holding part 51 and the television receiver 20 and the distance between the antenna holding part 56 and the television receiver 20 can be changed stepwise, the handle 50 and the pedestal 55 may be fixed to the television receivers 20, respectively, such that those distances can be continuously changed.

While the invention has been particularly shown and described with respect to preferred embodiments thereof, it should be understood by those skilled in the art that the forgoing and other changes inform and detail may be made therein without departing from the spirit and scope of the invention as defined in the appended claims.

What is claimed is:

1. A television receiving apparatus, comprising:

a television receiver;

an antenna having directivity capable of being electrically changed so as to match with radio waves to be received;

an antenna holding box holding the antenna therein, fixed to the television receiver, and provided with a distance changing mechanism capable of changing distance between the antenna and the television receiver; wherein the antenna comprises a receiving device which receives broadcast television signals and is capable of changing directivity of receiving the broadcast television signals, and the antenna holding box holds the receiving device horizontally therein, and the distance changing mechanism changes the distance while keeping the receiving device in the antenna holding box in a horizontal position.

2. The television receiving apparatus according to claim 1, wherein the antenna holding box includes:

an antenna holding part holding the antenna with the receiving device therein while keeping the receiving device can receives the broadcast television signals which are horizontally polarized waves and come from horizontal directions;

shafts each having a first end connected to the antenna holding part and a second end mounted on the television receiver so as to be slidable to change the distance between the antenna holding part and the television receiver; and a fixing mechanism for fixing the shafts to the television receiver such that the antenna holding part is at the predetermined distance from the television receiver.

3. The television receiving apparatus according to claim 1, wherein the antenna holding box is a handle attached to an upper part of the television receiver.

4. The television receiving apparatus according to claim 1, wherein the antenna holding box is a pedestal for supporting the television receiver.

5. The television receiving apparatus according to claim 1, wherein the antenna holding box includes:

an antenna holding part holding a broadcast digital signal receiving device that makes the antenna has a plurality of signal receiving directions in a horizontal plane;

two shafts each having a first end connected to the antenna holding part and a second end mounted on the television receiver so as to be slidable to change the distance between the antenna holding part and the television receiver; and a fixing mechanism for fixing the shafts to the television receiver such that the antenna holding part is at the predetermined distance from the television receiver;

wherein a section in a horizontal plane of the antenna holding part is substantially elliptic;

the respective first ends of the two shafts are connected to opposite end parts separated from each other of the antenna holding part, the respective second ends of the shafts can be partly or entirely received in the television receiver; and the antenna holding box is a handle attached to an upper part of the television receiver provided with a 15 to 23 in. display screen.

* * * * *